US005316308A

United States Patent [19]

Stembokas

[11] Patent Number: 5,316,308

[45] Date of Patent: May 31, 1994

[54] SHADOW BOARD GAME

[76] Inventor: Jeffrey Stembokas, 162 S. Evergreen Dr., Seldon, N.Y. 11784

[21] Appl. No.: 879,297

[22] Filed: May 7, 1992

[51] Int. Cl.[5] ..... A63F 3/00

[52] U.S. Cl. ..... 273/249; 273/440; 273/445; 273/446

[58] Field of Search ..... 273/243, 249-254, 273/272, 440, 445, 446

[56] References Cited

U.S. PATENT DOCUMENTS

| | | | |
|---|---|---|---|
| 4,323,249 | 4/1982 | Brady | 273/249 |
| 4,448,423 | 5/1984 | Augusta | 273/272 |
| 4,962,934 | 10/1990 | Taylor | 273/249 |
| 4,966,371 | 10/1990 | Sherman | 273/243 |

OTHER PUBLICATIONS

"Strip" Checkers, Breck Catalog.

Dr. Ruth's Game of Good Sex, Games Magazine, Feb. 1986, p. 50.

*Primary Examiner*—Benjamin H. Layno

*Attorney, Agent, or Firm*—Galgano & Burke

[57] ABSTRACT

A shadow board game is provided and includes a shadow casting device used in conjunction with a board game for fun by the players. Acts acted out in shadow casting can be simulated in shadow by actual physical contact during the play of the game by the players from instructions taken from a game board. The player with the highest points at the end of the game wins.

13 Claims, 6 Drawing Sheets

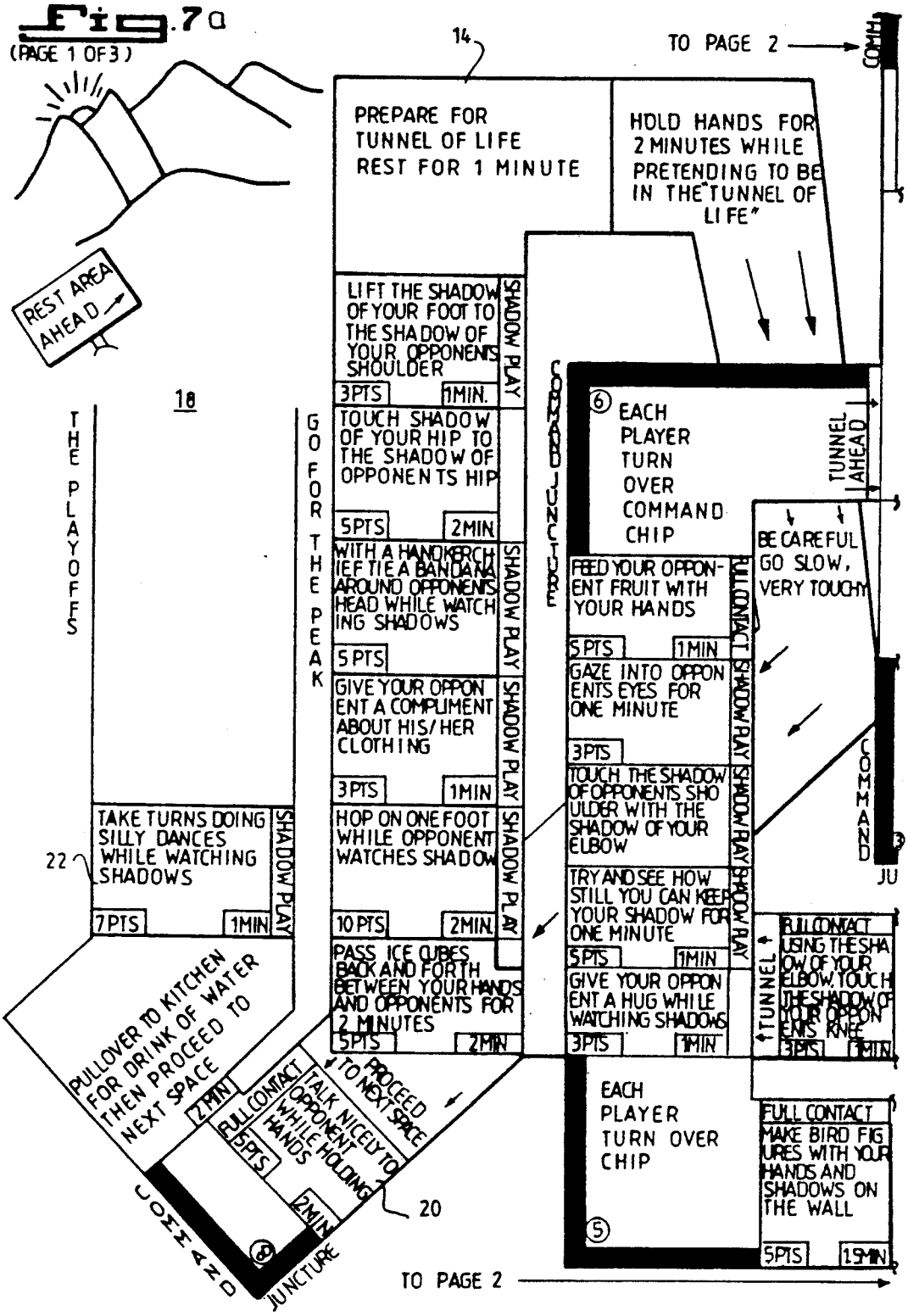
Fig. 7a
(PAGE 1 OF 3)
14
TO PAGE 2
PREPARE FOR TUNNEL OF LIFE REST FOR 1 MINUTE
HOLD HANDS FOR 2 MINUTES WHILE PRETENDING TO BE IN THE "TUNNEL OF LIFE"
REST AREA AHEAD
LIFT THE SHADOW OF YOUR FOOT TO THE SHADOW OF YOUR OPPONENTS SHOULDER
3PTS 1MIN.
SHADOW PLAY
18
THE PLAYOFFS
GO FOR THE PEAK
TOUCH SHADOW OF YOUR HIP TO THE SHADOW OF OPPONENTS HIP
5PTS 2MIN
WITH A HANDKERCHIEF TIE A BANDANA AROUND OPPONENTS HEAD WHILE WATCHING SHADOWS
5PTS
GIVE YOUR OPPONENT A COMPLIMENT ABOUT HIS/HER CLOTHING
3PTS 1MIN
HOP ON ONE FOOT WHILE OPPONENT WATCHES SHADOW
10PTS 2MIN
PASS ICE CUBES BACK AND FORTH BETWEEN YOUR HANDS AND OPPONENTS FOR 2 MINUTES
5PTS 2MIN
COMMAND JUNCTURE
6
EACH PLAYER TURN OVER COMMAND CHIP
TUNNEL AHEAD
BE CAREFUL GO SLOW, VERY TOUCHY
FEED YOUR OPPONENT FRUIT WITH YOUR HANDS
5PTS 1MIN
FULL CONTACT
GAZE INTO OPPONENTS EYES FOR ONE MINUTE
3PTS
TOUCH THE SHADOW OF OPPONENTS SHOULDER WITH THE SHADOW OF YOUR ELBOW
TRY AND SEE HOW STILL YOU CAN KEEP YOUR SHADOW FOR ONE MINUTE
5PTS 1MIN
GIVE YOUR OPPONENT A HUG WHILE WATCHING SHADOWS
3PTS 1MIN
TUNNEL
FULL CONTACT USING THE SHADOW OF YOUR ELBOW, TOUCH THE SHADOW OF YOUR OPPONENTS KNEE
3PTS 1MIN
COMMAND JU
22
TAKE TURNS DOING SILLY DANCES WHILE WATCHING SHADOWS
7PTS 1MIN
PULLOVER TO KITCHEN FOR DRINK OF WATER THEN PROCEED TO NEXT SPACE
2MIN
FULL CONTACT
TALK NICELY TO OPPONENT WHILE HOLDING HANDS
5PTS
2MIN
PROCEED TO NEXT SPACE
20
COMMAND JUNCTURE
8
5
EACH PLAYER TURN OVER CHIP
FULL CONTACT
MAKE BIRD FIGURES WITH YOUR HANDS AND SHADOWS ON THE WALL
5PTS 1.5MIN
TO PAGE 2

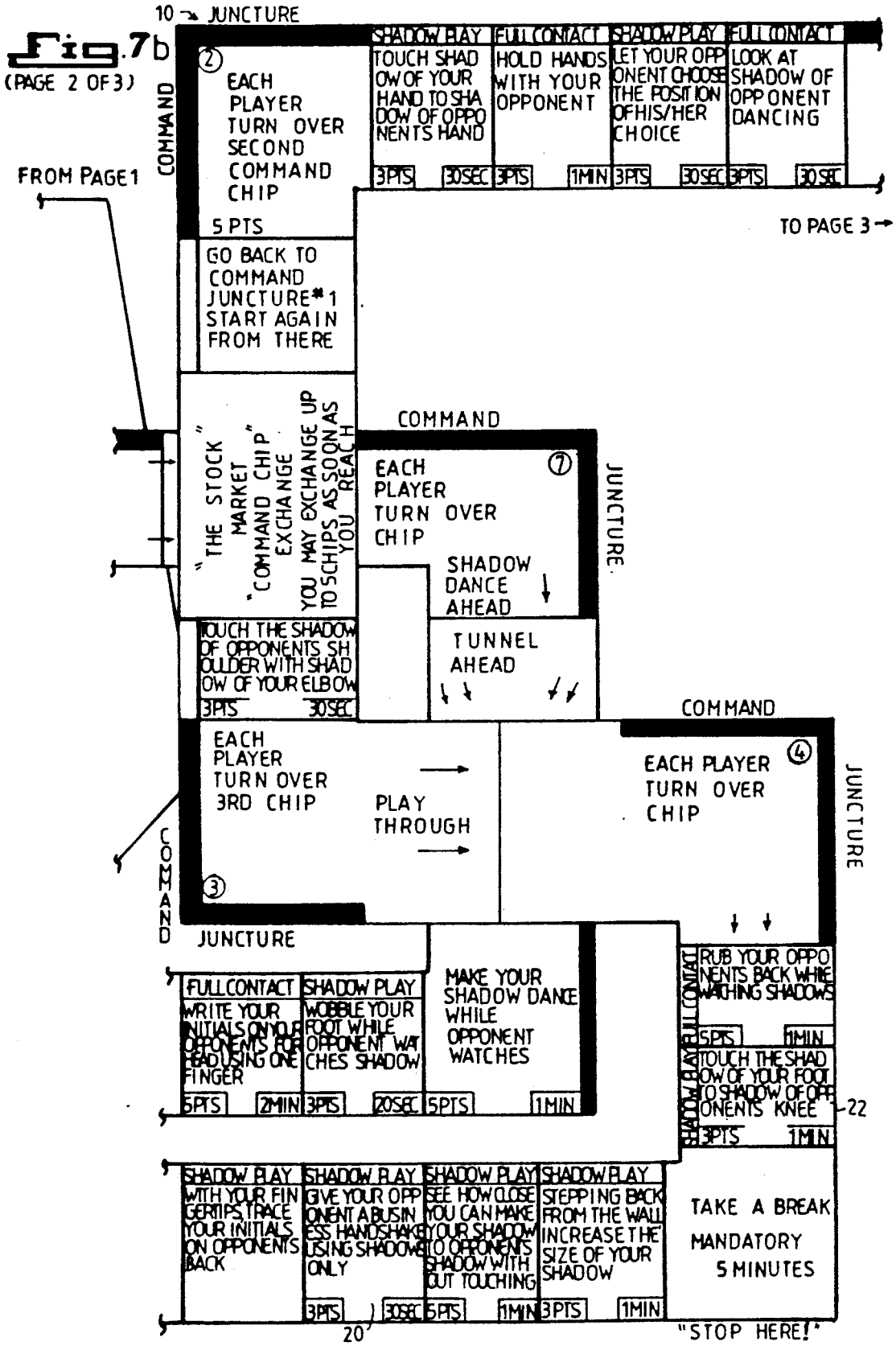
Fig.7b
(PAGE 2 OF 3)
10 JUNCTURE
COMMAND
FROM PAGE 1
EACH PLAYER TURN OVER SECOND COMMAND CHIP
5 PTS
SHADOW PLAY
TOUCH SHADOW OF YOUR HAND TO SHADOW OF OPPONENTS HAND
3PTS 30SEC
FULL CONTACT
HOLD HANDS WITH YOUR OPPONENT
3PTS 1MIN
SHADOW PLAY
LET YOUR OPPONENT CHOOSE THE POSITION OF HIS/HER CHOICE
3PTS 30SEC
FULL CONTACT
LOOK AT SHADOW OF OPPONENT DANCING
3PTS 30SEC
TO PAGE 3
GO BACK TO COMMAND JUNCTURE #1 START AGAIN FROM THERE
"THE STOCK MARKET" "COMMAND CHIP" EXCHANGE
YOU MAY EXCHANGE UP TO 5 CHIPS AS SOON AS YOU REACH
COMMAND
EACH PLAYER TURN OVER CHIP
SHADOW DANCE AHEAD
JUNCTURE
TOUCH THE SHADOW OF OPPONENTS SHOULDER WITH SHADOW OF YOUR ELBOW
3PTS 30SEC
TUNNEL AHEAD
COMMAND
EACH PLAYER TURN OVER 3RD CHIP
PLAY THROUGH
EACH PLAYER TURN OVER CHIP
JUNCTURE
COMMAND
JUNCTURE
FULL CONTACT
WRITE YOUR INITIALS ON YOUR OPPONENTS FOREHEAD USING ONE FINGER
5PTS 2MIN
SHADOW PLAY
WOBBLE YOUR FOOT WHILE OPPONENT WATCHES SHADOW
3PTS 20SEC
MAKE YOUR SHADOW DANCE WHILE OPPONENT WATCHES
5PTS 1MIN
FULL CONTACT
RUB YOUR OPPONENTS BACK WHILE WATCHING SHADOWS
5PTS 1MIN
SHADOW PLAY
TOUCH THE SHADOW OF YOUR FOOT TO SHADOW OF OPPONENTS KNEE
3PTS 1MIN
22
SHADOW PLAY
WITH YOUR FINGERTIPS TRACE YOUR INITIALS ON OPPONENTS BACK
SHADOW PLAY
GIVE YOUR OPPONENT A BUSINESS HANDSHAKE USING SHADOW ONLY
3PTS 30SEC
SHADOW PLAY
SEE HOW CLOSE YOU CAN MAKE YOUR SHADOW TO OPPONENTS SHADOW WITHOUT TOUCHING
5PTS 1MIN
SHADOW PLAY
STEPPING BACK FROM THE WALL INCREASE THE SIZE OF YOUR SHADOW
3PTS 1MIN
TAKE A BREAK
MANDATORY 5 MINUTES
20
"STOP HERE!"

(PAGE 3 OF 3)

SHADOW BOARD GAME

BACKGROUND OF THE INVENTION

1. Field of the Invention

The instant invention relates generally to board games and more specifically it relates to a shadow board game.

2. Description of the Prior Art

Numerous board games have been provided in prier art that are adapted to give entertainment to players by challenging them, so that they utilize their skill and acumen in playing the games, while at the same time an element of chance adds a bit of adventure and luck to the games. While these units may be suitable for the particular purpose to which they address, they would not be as suitable for the purposes of the present invention as heretofore described.

SUMMARY OF THE INVENTION

A shadow board game is provided which consists of a game board having a path within it's perimeter which has a beginning position and an end position. It is divided into consecutive playing spaces bearing instructions representing various tasks to do during the play of the game. A playing piece is for each of the players, with each playing piece representing a player and being of size to easily fit within the game board playing spaces. A die is for the purpose of determining, by each roll, the number of playing spaces to advance on the game board. A thirty second hour glass sand timer is for timing each of the tasks required by the players within the allotted time frame. A cloth sack grab bag is to enable players to reach in and randomly pick command chips, which contain the printed instructions for actions that the players are asked to perform. The command chips also have a scoring system. A score pad is for keeping score by each of the players. A light box is used for casting shadows of the players upon a wall, which is essential for the play of the game. A candle is also utilized for mood setting purposes.

The instant invention utilizes a shadow casting device in conjunction with a board game. There has been no other board games that use a shadow casting device or shadows in any way as part of the makeup or concept behind the game. The shadow is used to intrigue the participants of the game which is primarily a game designed for fun. Although there are games on the market, none are as different as this one. Because shadows are being used in sequence between players and are part of the concept, there are certain skills involved that can be practiced and perfected which creates a need to play the game over again.

The use of shadows within the context of the game is as follows: where players of other games may do some touching, this game provides a medium for which players can have their shadows touching each other on a wall, ceiling, screen or other backdrop, without the participants having to touch or come into contact with each other. This is called shadow meshing. This form of play may take some experimentation. Experimentation takes time, so while players are trying to complete their specific commands through shadow meshing, they are trying to position each other so that maximum shadow effect on the wall is obtained. Once obtained, they may be asked to hold that position for a period of time in increments of thirty seconds or more, or to act out acts that are written on command chips. Some command chips ask that these actions be simulated in shadow only. This is intended to build excitement between the players, which is the purpose of the game. Players will be more aware of the other player(s) after the game has been played. Since there is a point scoring system involved, then competitive gratification and winning the game is of much importance.

A primary object of the present invention is to provide a shadow board game that will overcome the shortcomings of the prior art devices.

Another object is to provide a shadow board game in which a shadow casting device is used in conjunction with a board game for fun for the players.

An additional object is to provide a shadow board game in which acts acted out by shadow casting can be simulated in shadow or by actual physical contact during the play of the game by the players.

A further object is to provide a shadow board game that is simple and easy to use.

A still further object is to provide a shadow board game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIGS. *7a*, *7b* and *7c* collectively define top plan views of the game board in greater detail.

DETAILED DESCRIPTION OF THE PREFERRED EMBODIMENTS

Figure 1:
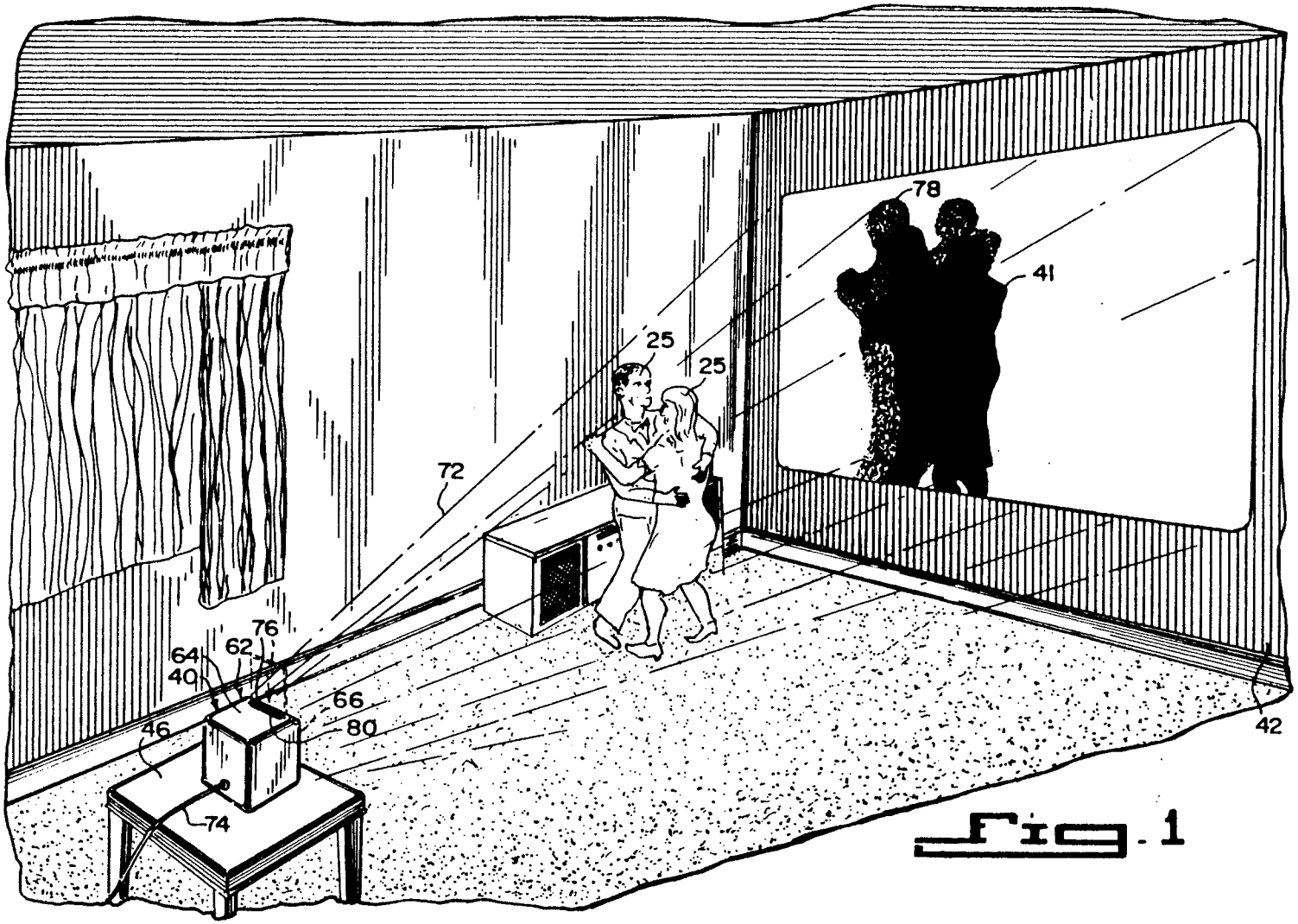
FIG. 1 is a side perspective view of the light box with a slide casting in combination a shadow from the slide and the shadow of the two people onto the wall.
Figure 2:
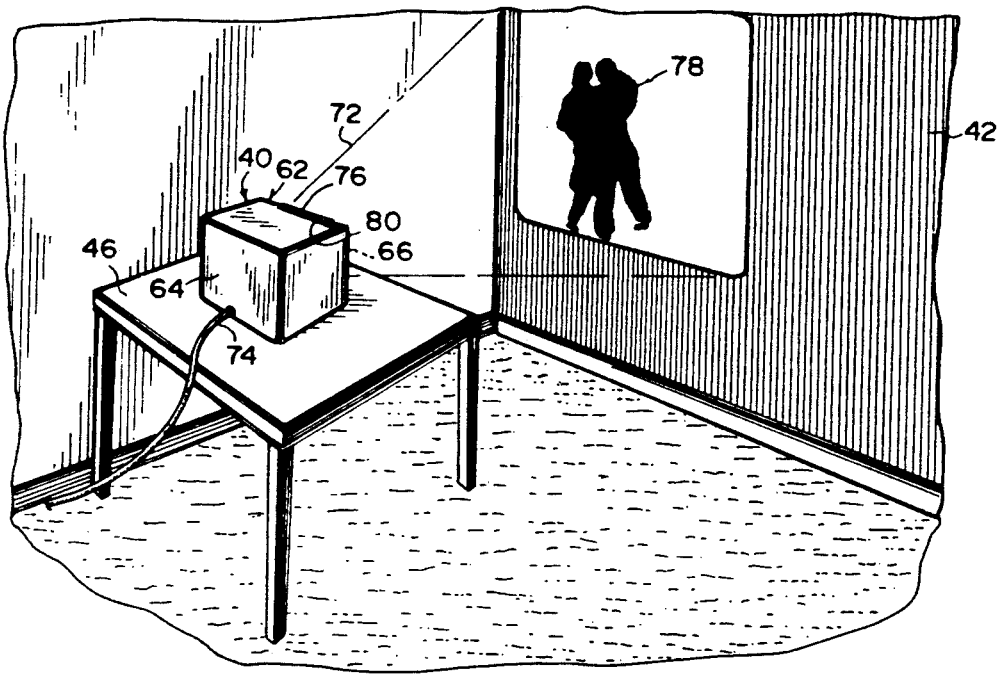
FIG. 2 is a side perspective view of just the light box with the slide casting a shadow from the slide onto the wall.

Turning now descriptively to the drawings, in which similar reference characters denote similar elements throughout the several views, the Figures illustrate a shadow board game which consists of a game board 10 having a path 12 within it's perimeter 14 with a beginning position 16 and an end position 18. The path 12 is divided into consecutive playing spaces 20 bearing instructions 22 representing various tasks to do during the play of the game. (See FIGS. *7a*, *7b* and *7c*). A plurality of playing pieces 24 are provided with one representing each player 25. Each playing piece 24 is of a size to easily fit within each playing space 20 on the game board 10. A gaming piece 26 is for producing by chance a random output count to indicate a number of playing spaces 20 on the game board 10, to be moved by one of the playing pieces 24. An apparatus 28 is for timing each task required by each of the players 25 within an allotted time frame. A plurality of command chips 30 are provided with each having thereon instructions 32 for a task for a player 25 to perform, time amount 34 allotted for the task and a point scoring amount 26. A score pad 38 is provided and is used for keeping score by each player 25 during the play of the game. A device 40 is for casting shadows 41 of the players 25 onto a wall 42, for carrying out some of the tasks to do during the play of the game. The players 25 can be located in a location 44 situated between the shadow casting device 40 on a table 46 and the wall 42 (see FIG. 1).

Figure 4:
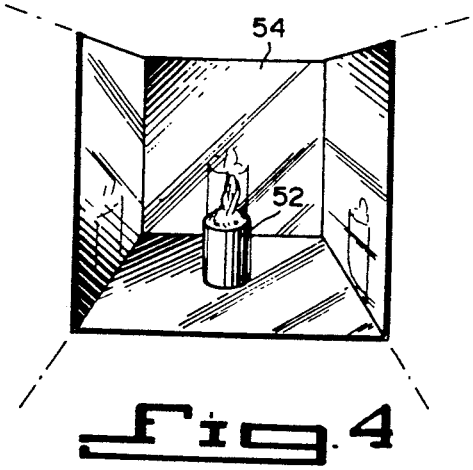
FIG. 4 is a front perspective view of a reflective candle holder.

The shadow board game 10 further includes a plurality of mock contract agreements 48 setting out terms and conditions for the players 25. A grab bag 50 is used to hold the command chips 30 therein for random drawing by the players 25. A plurality of candles 52 are used in conjunction with the play of the game, while a reflective holder 54 is for one of the candles 52 (see FIG. 4). A set of instructions 56 is to inform the players 25 how to play the game.

The random output count chance producing gaming piece 26 is a die 58. The timing apparatus 28 is a thirty second hour glass sand timer 60.

Figure 3:
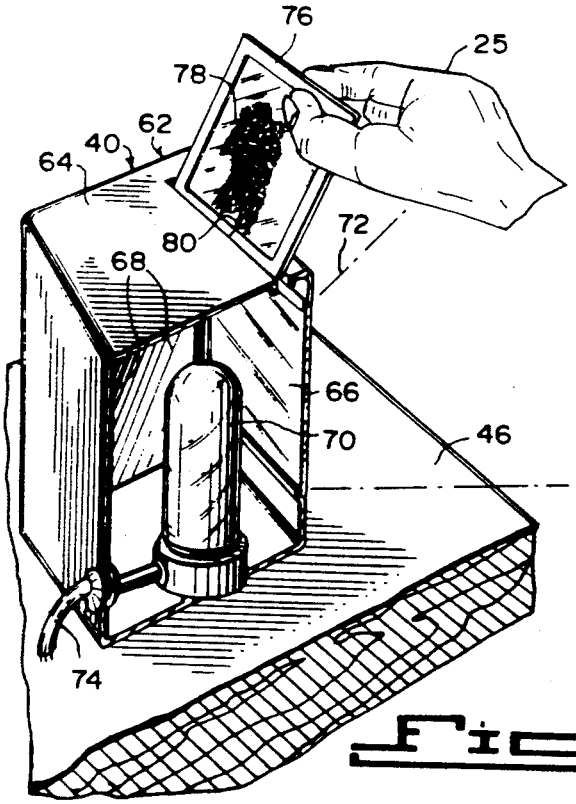
FIG. 3 is a side perspective view with parts broken away showing the slide being inserted into the light box.

The shadow casting device 40 is a light box 62, as best seen in FIG. 3, that includes an enclosure 64 having a front transparent window 66 and internally reflective rear and side surfaces 68. A lamp 70 is mounted within the enclosure 64 for producing a light source 72 to shine off of the internally reflective rear and side surfaces 68 and out of the front transparent window 66 in the enclosure 64. The players 25 in front of the enclosure 64 will cause their shadows 41 to be cast upon the wall 42 during the play of the game. A line cord 74 extends from the lamp 70 out of the enclosure for supplying a source of power to the lamp 70, so as to energize the lamp to produce the light source 72.

A slide 76 can also be provided, having an image 78 of a simulated shadow of at least another player. The slide 76 is insertable into a slot 80 in the enclosure 64 of the light box 62 between the lamp 70 and the front transparent window 66. The image 78 of the simulated shadow can be cast upon the wall 42 to be used in conjunction with the shadow of at least one live player 25, during the play of the game.

The shadow board game further contains a storage box 82, (see FIG. 5), for holding the various components therein when not being used. The storage box 82 includes a base 84 having side walls 86 to form a generally rectangular configuration and an insert 88 that fits into the base 84. The insert 88 has compartments 90, for storing most of the various components therein. A cover 92 fits over the side wall 86 of the base 84. A plurality of retainer members 94 are affixed to the underside 96 of the cover 92 for storing the plurality of mock contract agreements 48 and the set of instructions 56 thereto.

Figure 5:
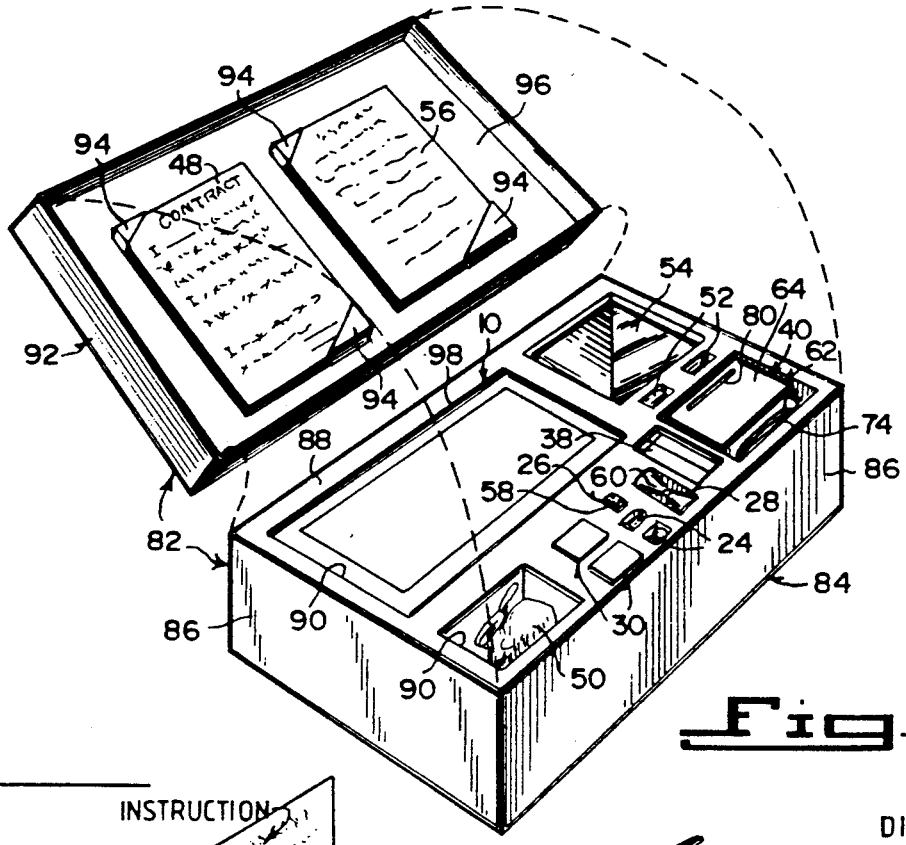
FIG. 5 is a perspective view of a box with its cover removed showing the various components of the instant invention disposed therein.
Figure 6:
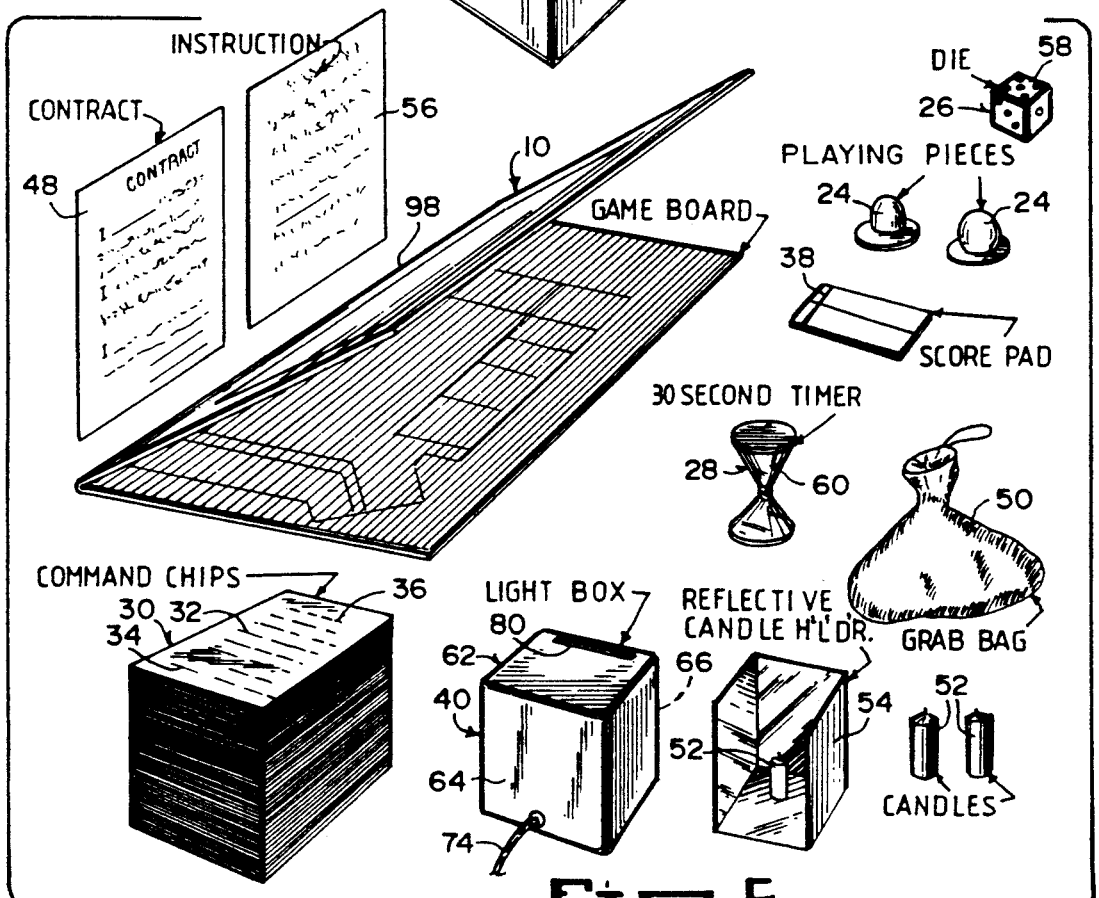
FIG. 6 is a composite perspective view showing the various components of the instant invention.
Figure 7C:
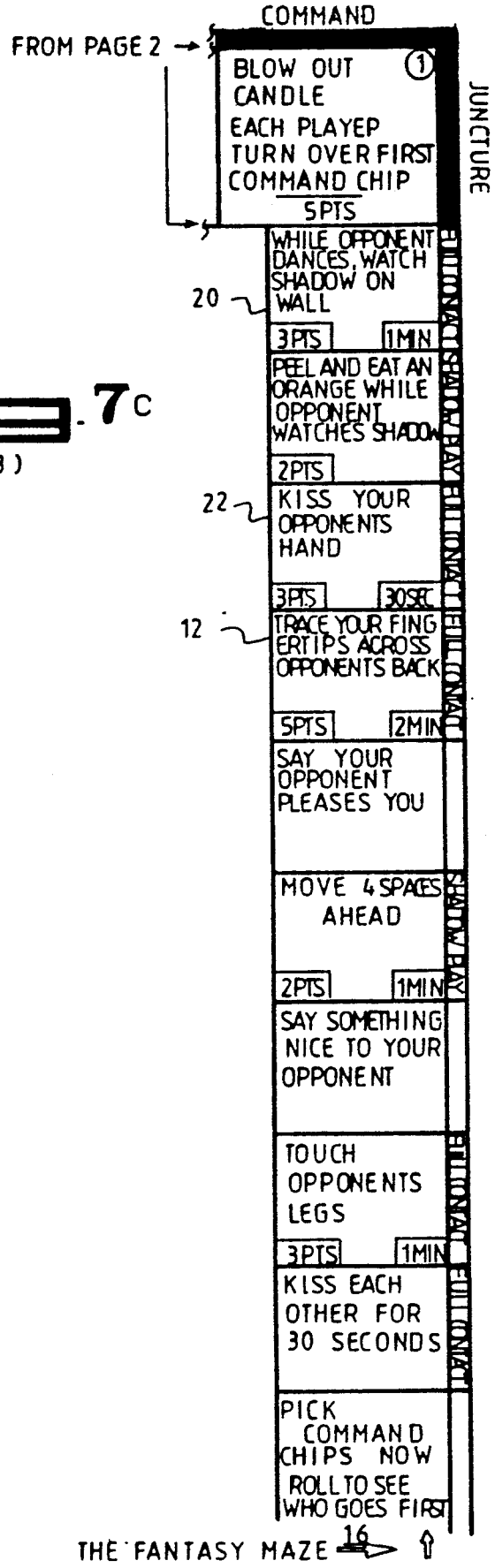

The game board 10 further includes a fold line 98 thereacross, (see FIGS. 5 and 6). The game board 10 can be folded in half to be stored in a respective compartment 90 in the insert 88 of the storage box 82, when not being used.

PREPARATIONS FOR PLAYING THE GAME (OPTIONAL)

In preparing for the game, each player 25 will be better off if they have these simple props standing by:

1. A hat and garments.
2. Various fruits and/or vegetables.
3. Toys.
4. Creams and baby oil.

Note: Understand this, these items are not completely necessary to play the game.

PHASE 1—CHOOSING COMMAND CHIPS 30

Lights Off-Candle 52 On

1. Each players 25 rolls the die 58 once.
2. The players 25 with the high roll (player one) picks two command chops 30 from the grab bag and places them face down on a table 46.
3. The next player 25 (player two), then picks two command chips 30 from the grab bag 50.
4. Both players 25 roll the die 58 again.
5. Following the preceding procedure, each player 25 chooses three command chips 30.
6. Both players 25 roll the die 58 again, choosing two more command chips 30.
7. Each player 25 should have seven command chips 30 face down.
8. Players should not show an opponent there commands chips.
9. Each player 25 may read and arrange their command chips 30 in any order they desire from left to right.
10. Once the command chips 30 are arranged, the order may not be changed.

PHASE 2—FANTASY MAZE

1. Each player 25 will choose a playing piece 24.
2. Player one now rolls the die 58 and advances the playing piece 24 to the appropriate playing space 20 on the game board 10 and follows the instructions.
3. Player two rolls the die 58, advances accordingly and follows instructions.
4. Each player 25, in turn, rolls the die 58 again and advances to the next playing space 20.
5. If any player 25 should pass the first command juncture, that player 25 should momentarily stop and follow juncture instructions before proceeding to the appropriate playing space 20.
6. The first player 25 to reach the first command juncture receives five points.
7. On the game board 10 there will be an area on each playing space 20, where it will be stated whether or not the task to be fulfilled is done in shadow play or full contact.
8. Shadow play allows the players 25 only to touch shadows together with no physical contact involved.
9. This is where the players 25 will have to stand apart from each other to the point where only the shadows touch.
10. Full contact may instruct the players 25 to touch each other and to watch the shadows as they are completing the prescribed task.
11. Some full contact may take a player 25 away from the shadow on the wall 42 altogether, such as to another room, or shower.
12. At this time each player 25 flips their first command chip 30 over, simultaneously from left to right.

13. The player 25 who reached the command juncture first may play or pass the command juncture on to his/her opponent, depending upon what the directive is on the command chip 30.
14. The player 25 passing the command juncture retains the points 36 allotted on the command chip 30.
15. Rule 14 applies equally to all players 25, equally.

EXAMPLE

"His Command Chip 30"

Hold opponent's hand for thirty seconds.

"Her Command Chip 30"

Kiss opponent for 30 seconds.

16. In the above example, the male player 25 would pass his command to his opponent and retain the points 36, while the female player 25 would pass her command to him and also retain her points 36.
17. The command chip stock market—there will be a section in the fantasy maze that will be the command chip stock market.
18. This area is a opportunity for players 25 to trade in some of their command chips 30 to the grab bag 50 that might not be suitable for them, or command chips 30 that might not be directed at their opponent and not usable to them.
19. A player 25 may trade in up to five command chips 30, which could change the whole course of the game.
20. Each player 25 keeps rolling the die 58 and advancing into the fantasy maze accordingly.
21. As the player 25 lands on a playing space 20, the player will do as directed.
22. Again, the first player 25 to pass a command juncture will stop there momentarily.
23. Then the second command chip 30, from left to right, will be flipped over by both players 25.
24. If and when a player 25 reaches the playoffs and there are any command chips 30 left in their possession, they are all to be turned over, acted out, and final points 36 tallied up.
25. Loss of a command chip 30 and the points 36 on it to an opponent occurs when a player 25 does not fulfill his/her obligation according to contract 48 or he/she grabs or touches an opponent when the command states not to.
26. The slide 76 is for the purpose of creating extra shadows 78 for the single player 25.
27. The slide 76 is optional and can be used to create a variation in the game.
28. A two player couple could also use the slide 76 to combine their shadows 41 with the extra shadow 78 in the game plan.

SAMPLE LETTER OF INSTRUCTION FOR A SINGLE PLAYER 25

Dear Player,

Although you have no one to roll the die with, you have been provided with this light box and optional shadow slides which create shadows for you to use in your own fantasy.

Just drop the shadow slide through the slot and play with your new found fantasy friend.

If you do not have the shadow slides then you are left to your own imagination.

SAMPLE OF THE MOCK CONTRACT AGREEMENT 48

THE SHADOW
FANTASY MAZE
CONTRACT

I _____ hereby agree that I will fulfill my commands to the best of my ability and that I understand the consequences if I do not.

I acknowledge that if I loose the game that I will _____ for my opponent.

I acknowledge that if I loose the game that I will _____ for my opponent.

| LIST OF REFERENCE NUMBERS | |
|---|---|
| 10 | game board |
| 12 | path on 10 |
| 14 | perimeter of 10 |
| 16 | beginning position of 12 |
| 18 | end position of 12 |
| 20 | playing space in 12 |
| 22 | instructions in 20 |
| 24 | playing piece |
| 25 | player |
| 26 | gaming piece |
| 28 | timing apparatus |
| 30 | command chip |
| 32 | instruction on 30 |
| 34 | time amount on 30 |
| 36 | point scoring amount on 30 |
| 38 | score pad |
| 40 | shadow casting device |
| 41 | shadow of 25 |
| 42 | wall |
| 44 | bed for 25 |
| 46 | table for 40 |
| 48 | mock contract agreement |
| 50 | grab bag for 30 |
| 52 | candle |
| 54 | reflective holder for 52 |
| 56 | instructions |
| 58 | die for 26 |
| 60 | thirty second hour glass sand timer for 28 |
| 62 | light box for 40 |
| 64 | enclosure |
| 66 | front transparent window in 64 |
| 68 | internally reflective rear and side surfaces |
| 70 | lamp |
| 72 | light source |
| 74 | line cord |
| 76 | slide |
| 78 | image of simulated player on 76 |
| 80 | slot |
| 82 | storage box |
| 84 | base |
| 86 | side wall of 84 |
| 88 | insert for 84 |
| 90 | compartment in 88 |
| 92 | cover |
| 94 | retainer member |
| 96 | underside of 92 |
| 98 | fold line on 10 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A shadow board game which comprises:

a) a game board having a path within its perimeter with a beginning position and an end position, said path is divided into consecutive playing spaces bearing instructions representing various tasks to do during the play of the game including at least some of said tasks requiring the casting of players' shadows;

b) a plurality of playing pieces, one representing each player with each said playing piece being of a size to easily fit within each playing space on said game board;

c) means for producing by chance, a random output count to indicate a number of playing spaces on said game board to be moved by one of said playing pieces;

d) means for timing each task required by each of the players within an allotted time frame;

e) a plurality of command chips, each having thereon instructions for a task for a player to perform, time amount allotted for the task, and a point scoring amount;

f) a score pad, used for keeping score by each player during the play of the game; and g) means for casting shadows of the players onto a wall for carrying out some of said tasks requiring the casting of players' shadows.

2. A shadow board game as recited in claim 1, further including a plurality of mock contract agreements setting out terms and conditions for the players.

3. A shadow board game as recited in claim 2, further including a grab bag used to hold said command chips therein for random drawing by the players.

4. A shadow board game as recited in claim 3, further including a plurality of candles used in conjunction with the play of the game.

5. A shadow board game as recited in claim 4, further including a reflective holder for one of said candles.

6. A shadow board game as recited in claim 5, further including a set of instructions to inform the players how to play the game.

7. A shadow board game as recited in claim 6, wherein said random output count chance producing means is a die.

8. A shadow board game as recited in claim 7, wherein said timing means is a thirty second hour glass sand timer.

9. A shadow board game as recited in claim 4, wherein said shadow casting means is a light box, said casting means is a light box, said light box includes an enclosure having a front transparent window and internally reflective rear and side surfaces, a lamp mounted within said enclosure for producing a light source to shine off of said internally reflective rear and said side surfaces and out of said front transparent window in said enclosure, so that the players in front of said enclosure will cause their shadows to be cast upon the wall during the play of the game, and a line cord extending from said lamp out of said enclosure for supplying a source of power to said lamp, so as to energize said lamp to produce said light source.

10. A shadow board game as recited in claim 9, further including a slide having an image of a simulated shadow of at least another player, said slide being insertable into a slot in said enclosure of said light box between said lamp and said front transparent window, so that the image of said simulated shadow can be cast upon the wall to be used in conjunction with the shadow of at least one live player during the play of the game.

11. A shadow board game as recited in claim 10, further including a storage box for holding the various components therein when not being used.

12. A shadow board game as recited in claim 11, wherein said storage box includes:

a) a base having side walls to form a generally rectangular configuration;

b) an insert to fit into said base, said insert having compartments for storing most of the various components therein;

c) a cover to fit over said side walls of said base; and d) a plurality of retainer members affixed to the underside of said cover for storing said plurality of mock contract agreements and said set of instructions thereto.

13. A shadow board game as recited in claim 12, wherein said game board further includes a fold line thereacross, so that said game board can be folded in half and stored in a respective compartment in said insert of said storage box when not being used.

* * * * *